United States Patent [19]

Kitai et al.

[11] 4,015,417

[45] Apr. 5, 1977

[54] ALARM TIME SETTING NOTIFYING MECHANISM FOR A CLOCK OR THE LIKE

[75] Inventors: Kiyoshi Kitai, Tokyo; Masuo Ogihara, Chiba; Kouzo Sato, Yotsukaido; Nobuo Shinozaki, Chiba, all of Japan

[73] Assignee: Seiko Koki Kabushiki Kaisha, Japan

[22] Filed: Apr. 7, 1975

[21] Appl. No.: 565,469

[30] Foreign Application Priority Data

Apr. 8, 1974 Japan ..... 49-39618

[52] U.S. Cl. ..... 58/22.7; 58/16 D; 58/38 R; 58/50 R; 58/152 B

[51] Int. Cl.[2] ..... G04B 23/02; G04B 13/02; G04B 19/30

[58] Field of Search ..... 58/16 D, 19 R, 22.5, 58/22.7, 38, 50 R, 152 B

[56] References Cited

UNITED STATES PATENTS

| | | | |
|---|---|---|---|
| 3,292,360 | 12/1966 | Mahon | 58/22.7 |
| 3,474,617 | 10/1969 | Robinson et al. | 58/16.5 |
| 3,485,031 | 12/1969 | Richmond | 58/22.5 |
| 3,609,956 | 10/1971 | Funaki | 58/16 D |

*Primary Examiner*—E. S. Jackmon
*Attorney, Agent, or Firm*—Robert E. Burns; Emmanuel J. Lobato; Bruce L. Adams

[57] ABSTRACT

An alarming device for a clock comprises a manual selector for setting the desired alarm time. An alarm time setting detecting mechanism coacts with the rotationally driven time wheels of the clock for detecting the preset alarm time and thereafter actuates an audible alarm. An alarm time indicating mechanism provides a visual indication of the preset alarm time and includes a notifying mechanism which provides a visual indication indicative of the operative or inoperative state of the alarming device thereby notifying the user as to whether or not the device is set to detect an alarm time. The notifying mechanism comprises ON and OFF indicia which may be selectively illuminated or which may be selectively covered by a masking plate to provide the visual indication.

3 Claims, 5 Drawing Figures

ON
OFF

ALARM TIME SETTING NOTIFYING MECHANISM FOR A CLOCK OR THE LIKE

BACKGROUND OF THE INVENTION

The invention relates to an alarm time setting notifying mechanism for such time-telling devices as clocks, timers or the like, and having means to notify the user that the alarming device is in either operative or inoperative.

The conventional alarming device generally known thus far has an alarm time setting wheel for setting any desired alarm time and an alarm time setting selector switch for setting the alarming device in either the operative or inoperative state in an independent manner; however, the alarming device of this category has several defects. For example, proper time-telling is not effectuated at the time specifically designated therefor due to failing to set the selector switch at such a position as enables to start the alarming action when the alarming time is properly set by the operation of the alarm time setting wheel in a regular manner, or the position of the alarm time setting selector switch cannot be confirmed with ease away from a position apart from a clock.

The alarm time setting notifying mechanism according to the present invention is specifically contrived for the specific purpose of providing a new alarm time setting notifying mechanism for use with a clock or the like, by arranging in place such a means whereby an alarm time setting selector is properly caused to notify the effect of being set in the state of being either operative or inoperative for proper alarming action, thus eliminating the said defects involved in the conventional alarming device. Furthermore, the said notifying means is electrically or mechanically incorporated with the alarm time setting wheel, whereby the notifying effect is all the more enhanced. A detailed description of this alarm time setting notifying mechanism for a clock or the like will be given below with reference to the drawings showing an illustration thereof applied to an alarming device of a clock.

DETAILED DESCRIPTION OF PREFERRED EMBODIMENTS

Figure 1:
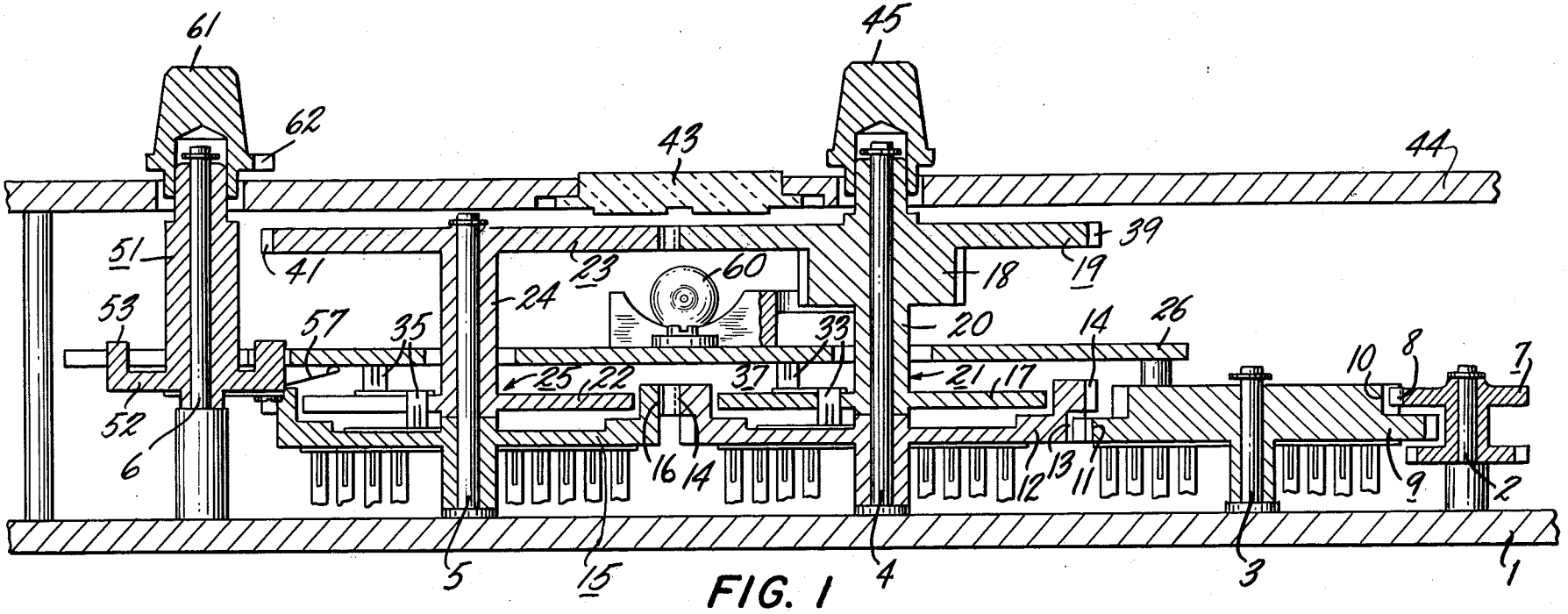
FIG. 1 is a longitudinal section of the main portion of a clock provided with the alarm time setting notifying mechanism according to the present invention.
Figures 2, 3:
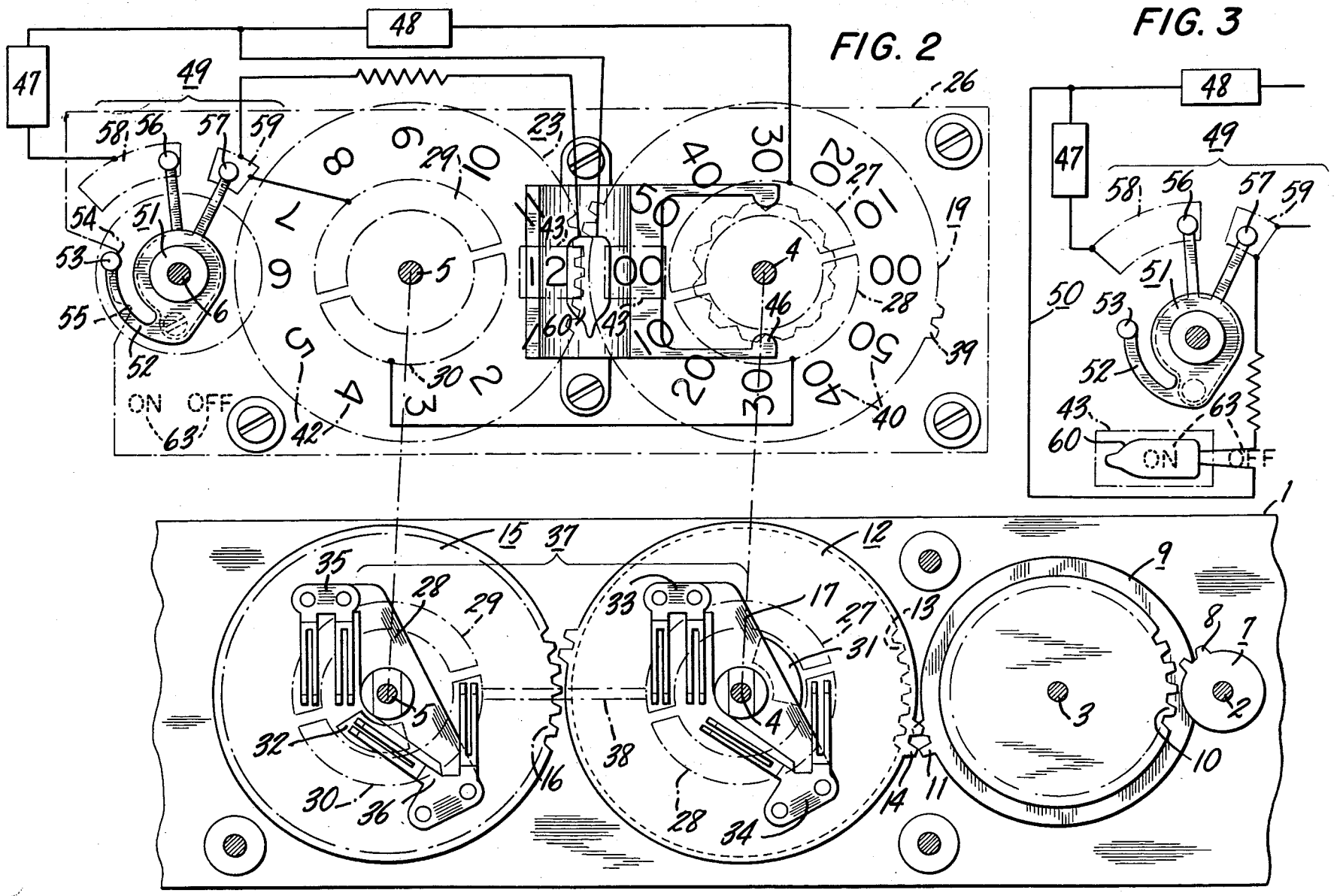
FIG. 2 is a front view thereof showing the alarm time setting notifying mechanism and the time wheel spearated from each other.
FIG. 3 is a front view of another embodiment of the alarm time setting notifying mechanism.

Shown first in FIGS. 1 and 2 are main sections of the mechanism of a clock. A series of shafts 2, 3, 4, 5 and 6 are set in place upright and rotatably supported on a base plate 1 in a linear line, the shaft 2 has a drive wheel 7 provided with shift tooth 8, the shaft 3 has a minute time wheel 9 provided with a series of continuous teeth 10 engageable with the and shift tooth 8 also provided with a shift tooth 11. The shaft 4 has a 10 minute time wheel 12 provided with a series of continuous teeth 13 engageable with the shift tooth 11 and also provided with two sets of shift teeth 14, 14, and the shaft 5 has a hour time wheel 15 provided with a series of continuous teeth 16 disposed to be engaged with the shift tooth 14. The drive wheel 7 has torque transmitted thereto from the source of driving force (for instance, a synchronous motor), whereby the time wheels are revolved by a uniform angle in an intermittent manner.

The alarming device comprises an alarm time setting detecting mechanism, an alarm time indicating mechanism, and an alarm time telling mechanism, as the main constituent parts thereof.

The alarm time setting detecting mechanism is constituted as set forth below. An alarm time 10 minute setting piece 21 comprises an alarm time setting detecting member 17, a click wheel 18 and an alarm time 10 minute indicating wheel 19 all formed as an integral unit and attached to a spindle 20 so supported as to be free to revolve on the shaft 4 alarm time hour setting piece 25 comprises an alarm time setting detecting member 22 and an alarm time hour indicating wheel 23 formed as an integral one-piece unit and attached to a spindle 24 so supported as to be free to revolve on the shaft 5. The members 17 and 22 comprise electric contact pieces which are respectively connected to the wheels 19 and 23 for movement in unison therewith. The lower surface of a printed-circuit baseboard 26 is arranged between the time wheels 12, 15 and the indicating wheels 19, 23 and the baseboard has printed therein a pair of semi-ring-shaped 10 minute primary and secondary slide switch plates 27, 28 and fixed hour primary and secondary slide switch plates 29, 30 printed thereon, respectively. The switch plates comprise angular sectors which extend along the same circumferential zone concentrically of the shafts 4, 5. The upper surface of the time wheels 12, 15 has a fan-shaped small piece of a 10 minute revolving slide switch plate 31 and a fan-shaped small piece of a hour revolving slide switch plate 32 fixed at such positions corresponding to the inside of the said fixed switch plates 27, 28 and 29, 30, respectively. In addition the said 10 minute and hour time setting detecting plates 17, 22 have a pair of 10 minute alarm time primary and secondary contact pieces 33, 34 extended in a bifurcated shape to such positions as to come in contact with the said 10 minute fixed switch plates 27, 28 and the revolving switch plate 31, and the plates 17, 22 have a pair of hour alarm time primary and secondary contact pieces 35, 36 extended in a bifurcated shape to such positions as to come in contact with the said hour time fixed switch plates 29, 30 and the revolving switch plate 32. The switch plates and the said contact pieces constitute an electrical alarm time detecting mechanism 37. A connecting wire 38 is included for making electrical connection of the fixed switch plates 27, 30.

The alarm time indicating mechanism is constituted in such a manner as set forth below. The indicating wheel 19 is provided with two pairs of shift teeth 39, and 39, the upper surface peripheral portion thereof contains a set of 10 minute alarm time indications 40 (00, 10, 20, . . . 50). The indicating wheel 23 is provided with a continuous series of teeth 41 engageable with the said shift tooth 39, and the upper surface peripheral portion thereof contains a series of alarm time hour indications 42 (0, 1, 2, 3, . . . 12). An indicating and notifying opening 43 is formed in a cover 44 at a position corresponding to the horizontal alignments of the time indications 42, 40 and a knob 45 is set in place at the top end of the alarm time setting piece 21. A click 46 is positioned to be engaged with the said click wheel 18.

The time-telling mechanism is constituted mainly of a power source 47, a buzzer 48, and a circuit 50 including an alarm time setting switch 49, and is connected to the said alarm time detecting switching mechanism 37.

The alarm time setting notifying mechanism is connected with the said time-telling circuit 50, and the constitution thereof is as set forth below. An alarm time setting selector 51 made of non-electroconductive synthetic resin has an elastic click arm 52 extended therefrom in an integrated manner and is rotatably supported on the said shaft 6 in such a manner as to be free to revolve. A click 53 at the top of the said click arm 52 is pressed in contact with engaging grooves 54, 55 formed on the end side of the printed circuit baseboard 26 in such a manner as to be capable of being engaged and disengaged in an alternative manner, and the selector 51 has an alarm time setting switch 49 fixed in place at the lower portion thereof.

The alarm time setting switch 49 is provided with a pair of bifurcated slidable switch contact pieces 56, 57, of which one 56 is caused to come in contact with a fan-shaped slide switch plate 58 of suitable length which is connected on the side of the power source 47, while the other contact piece 57 is caused to come in contact with a short fan-shaped slide switch plate 59 which is connected on the side of the switching mechanism 37. In this case, when the selector 51 is turned clockwise and counterclockwise by engaging and disengaging the click 53, the contact piece 56 is kept in contact with the switch plate 58 at all times, whereas the other contact piece 57 comes into and out of contact with the switch plate 59.

In the present embodiment, an illuminating element 60 like a lamp or the like is employed as an alarm time setting notifying means, the illuminating element 60 being situated below the indicating opening 43 on the upper surface of the printed-circuit baseboard 26. The lamp 60 has one terminal thereof connected with the said slide switch plate 59 and has the other terminal thereof connected to one pole of an electric power source 47. A knob 61 is fixed on the upper end of the selector 51, and projects out of the cover 44. A pointing hand 62 is set in a protruding manner on the base of the knob 61, and designates an indication 63 on the cover (for instance, ON or OFF) indicating the switching state (--before or on or off--) of the switch 49.

Next, a description of the operation of the present alarm time setting mechanism will be given. In the state shown in FIG. 2, the alarm time 10 minute setting detecting member 17 of the alarm time detecting switch mechanism 37 is set at a position of a proper phase angle in relation to the revolving switch plate 31, to thus keep the switching mechanism 37 open. The indicating opening 43 displays the proposed alarm time (12 o'clock). The alarmm time setting switch 49 is closed to thus switch on the notifying lamp 60, and this lamp projects the alarm time indication (12 o'clock) in a luminous manner through the indicating opening 43 thereby notifying that the alarming device is in the operative state and that the proposed alarm time has been set.

In case the alarm time setting switch 49 is in the state of being open, the notifying lamp 60 is switched off, to thus notify that the alarming device is in the state of being inoperative.

As the time wheel revolves, and the revolving switch plate 31 and the alarm time setting detecting member 17 are conformed with each other in terms of their phase, the switching mechanism 37 closes. Stated otherwise, when the primary and the secondary contact pieces 33, 34 come in contact with the revolving switch plate 31, the switching mechanism 37 is closed to thereby perform time-telling.

In the embodiment shown in FIG. 3, the indicia ON, which constitutes one of the indications 63 denoting the state of being switched one or off (ON, OFF) of the alarm time setting switch 49, is provided directly on the glass of the notifying opening 43 formed in the cover 44. By such construction, when the indicating opening 43 is illuminated by the said notifying lamp 60, the indicia ON is illuminating thereby notifying that the alarming device is in the operative state.

Figure 4:
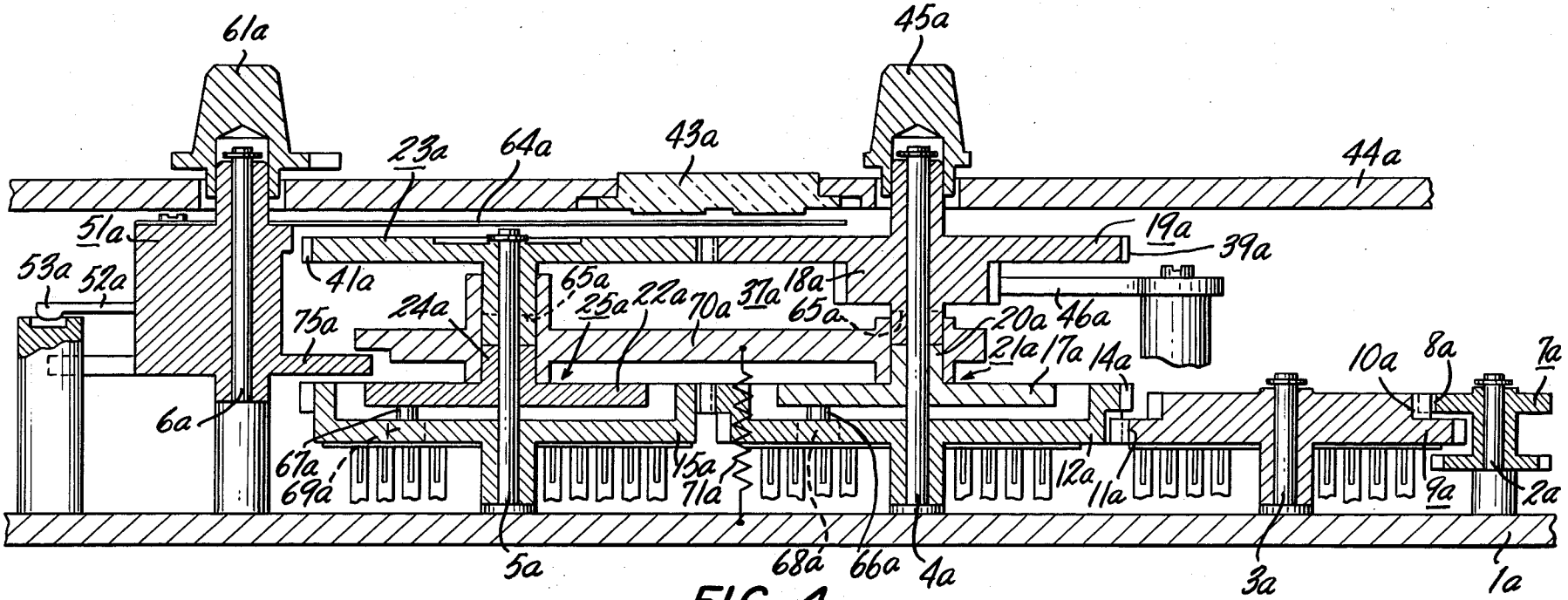
FIG. 4 is a longitudinal section of the main portion of another embodiment of a clock provided with another variant of alarm time setting notifying mechanism.
Figure 5:
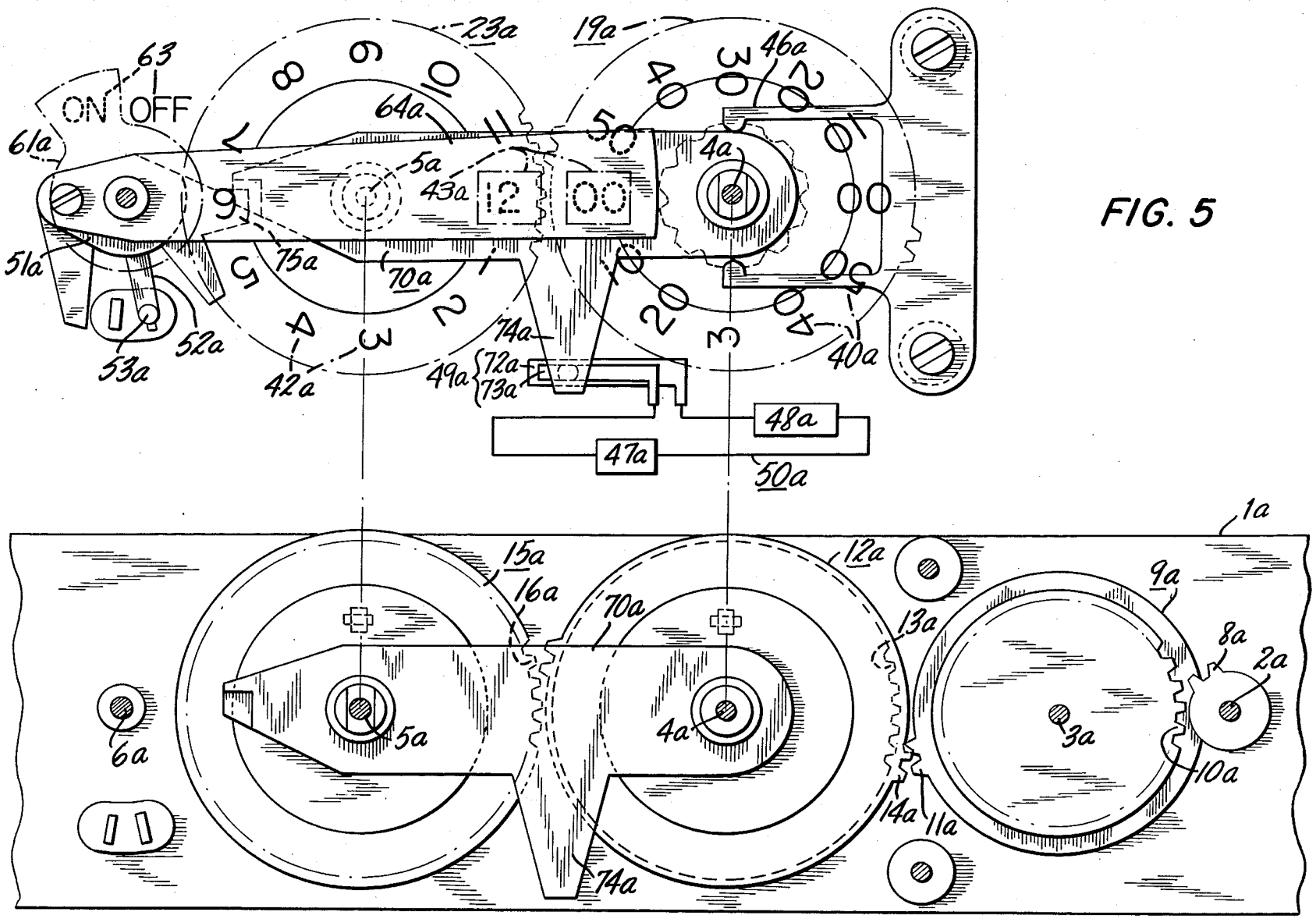
FIG. 5 is a front view thereof showing the said alarm time setting notifying mechanism and the time wheel separated from each other.

In the embodiment of the alarm time notifying mechanism shown in FIGS. 4 and 5, movable a masking cover 64*a* opens and closes the indicating-notifying opening 43. In this embodiment, the alarm time notifying mechanism is provided with a mechanical alarm time detecting mechanism 37*a*, the setting detecting members 17*a*, 22*a* are separated from and engaged with the portions of the spindles 20*a*, 24*a* in such a manner as to be capable of sliding in the axial direction in relation to the indicating wheels 19*a*, 23*a*, and the detecting members 17*a*, 22*a* have detecting projections 66*a*, 67*a* formed on the lower surface thereof. The upper surface of the time wheels 12*a*, 15*a* has detecting holes 68*a*, 69*a* formed thereon for enabling the projections to fall thereinto when the preset time is detected. A switch pressuring member 70*a* is supported in place on the upper position of the detecting members 17*a*, 22*a* in such a manner as to be free to slide on the spindles 20*a*, 24*a*, and the member 70*a* urges the detecting members 17*a*, 22*a* downwardly due to the biasing action of a spring 71*a*.

The time-telling circuit 50*a* is constituted of a power source 47*a*, a buzzer 48*a*, and an alarm time setting switch 49*a* having contact pieces 72*a*, 73*a*. The switch 49*a* coacts with a pushing arm 74*a* which extends out of the pressuring member 70*a*.

The alarm time setting selector 51*a* is provided with a lock arm 75*a* which extends beneath the lower surface of one end of the member 70*a* from one side thereof, and the selector 51*a* has the base of the masking cover 64*a*, which lies beneath the lower surface of the said indicating opening 43*a*, fixed in place on its upper surface. The said lock arm 75*a* and the said masking cover 64*a* are in such a positional relation as to be caused to synchronously advance and retreat with respect to the lower surface of the switching pressuring member or pushing plate 70*a* and the indicating opening 43*a*, respectively, in response to turning of the said selector 51*a*.

In the state shown in FIG. 4 and FIG. 5, the lock arm 75*a* of the selector 51*a* is set at such a position as to be capable of checking the switch pressuring member or pushing plate 70*a* from falling downward, and, at that time, the masking cover 64*a* is positioned below the indicating and notifying opening 43*a*, to make the indication of alarm time, thus notifying that the alarming device is in the inoperative state.

When the selector 51*a* is turned clockwise as shown in FIG. 5, the lock lever 75*a* is caused to be separated from the switch pushing plate 70*a*, and the masking cover 64*a*, for its part, too, is rocked over to the position for opening the indicating and notifying opening 43*a*, to thus project the indications of alarm time 40*a*, 42*a* through the said opening thereby notifying that the alarming device is in the operative state.

The other symbols shown in FIG. 4 and FIG. 5 represent substantially the same parts as those bearing the corresponding symbols shown in FIG. 1 and FIG. 2.

In the first embodiment of the alarm time setting notifying mechanism of the present invention, whether the alarming device is in the operative or inoperative state with regard to the alarming action is notified through the notifying means projected in the notifying opening kept open to the outside of this mechanism; therefore, proper operation of the alarm time setting selector is kept free from being left neglected at the time of the operation thereof for setting the desired alarming time. Furthermore, whether or not the alarm time setting notifying mechanism is in the operative state can be discerned from a position away from the clock, thus proving quite effective in the use thereof.

In the second embodiment of the alarm time setting notifying mechanism of the present invention, whether the alarming device is in the operative or inoperative state can be notified in all the more clear and distinct a manner through the notifying opening being illuminated or otherwise, at the time of conducting the operation thereof for setting the desired alarm time with an eye set at the alarm time indication projected through the notifying opening, whereby proper operation of the alarm time setting selector is kept free from being neglected. Furthermore, the state of the alarming action can be all the more clearly and distinctly discerned from a position away from the clock.

In the third embodiment of the alarm time setting notifying mechanism of the present invention, whether the alarming device is in the operative or inoperative state can be notified in all the more clear and distinct a manner through checking the notifying opening which is kept open or closed by the masking cover, at the time of conducting the operation thereof for setting the desired alarm time with an eye set at the alarm time indication which is projected through the indicating opening selected as the notifying opening.

What is claimed is:

1. In a clock of the type having an alarm device for detecting a preset alarm time and providing an audible alarm: alarm time indicating means for providing a visual indication of the preset alarm time; and alarm time setting notifying means for providing a visual indication indicative of the operative or inoperative state of said alarm device thereby notifying the user of the clock whether or not said alarm device is set to detect an alarm time, said alarm time setting notifying means comprising a manually movable selector movable to one position corresponding to the operative state of said alarm device and movable to another position corresponding to the inoperative state of said alarm device, means defining a notifying opening coacting with said alarm time indicating means to display therethrough the preset alarm time, an electrically energizeable illuminable element positioned so as to illuminate said notifying opening thereby illuminating the alarm time displayed therethrough, and switch means connected to an electric power source and connected to said selector for movement therewith and operative when said selector is moved to said one position to connect said illuminable element to said electric power source to thereby energize said element into illumination.

2. A clock according to claim 1; wherein said alarm time setting notifying means further includes indicia superposed on said notifying opening and illuminated by said illuminable element to provide an indication that said alarm device is in its operative state.

3. In a clock of the type having an alarm device for detecting a preset alarm time and providing an audible alarm: alarm time indicating means for providing a visual indication of the preset alarm time; and alarm time setting notifying means for providing a visual indication indicative of the operative or inoperative state of said alarm device thereby notifying the user of the clock whether or not said alarm device is set to detect an alarm time, said alarm time setting notifying means comprising a manually movable selector movable to one position corresponding to the operative state of said alarm device and movable to another position corresponding to the inoperative state of said alarm device, means defining a notifying opening coacting with said alarm time indicating means to display therethrough the preset alarm time, and a masking cover connected to said selector for movement therewith and configured so as to close said notifying opening when said selector is in said another position thereby notifying the user that said alarm device is in its inoperative state and to open said notifying opening when said selector is in said one position thereby notifying the user that said alarm device is in its operative state.

* * * * *